US011196144B2

(12) United States Patent
Hsu

(10) Patent No.: US 11,196,144 B2
(45) Date of Patent: Dec. 7, 2021

(54) ANTENNA ASSEMBLY AND WIRELESS COMMUNICATION DEVICE EMPLOYING SAME

(71) Applicant: Chiun Mai Communication Systems, Inc., New Taipei (TW)

(72) Inventor: Yi-Wen Hsu, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 265 days.

(21) Appl. No.: 16/502,128

(22) Filed: Jul. 3, 2019

(65) Prior Publication Data

US 2020/0014094 A1 Jan. 9, 2020

(30) Foreign Application Priority Data

Jul. 4, 2018 (CN) ..... 201810725796.5

(51) Int. Cl.

| | |
|---|---|
| ***H01Q 1/24*** | (2006.01) |
| ***H01Q 1/48*** | (2006.01) |
| ***H01Q 21/30*** | (2006.01) |
| ***H01Q 1/52*** | (2006.01) |
| ***H01Q 7/00*** | (2006.01) |

(52) U.S. Cl.

CPC ..... *H01Q 1/243* (2013.01); *H01Q 1/48* (2013.01); *H01Q 1/521* (2013.01); *H01Q 7/00* (2013.01); *H01Q 21/30* (2013.01)

(58) Field of Classification Search

CPC ..... H01Q 1/48; H01Q 1/243; H01Q 1/521; H01Q 1/36; H01Q 1/50; H01Q 21/30; H01Q 5/371; H01Q 9/42

See application file for complete search history.

(56) References Cited

U.S. PATENT DOCUMENTS

| | | | | |
|---|---|---|---|---|
| 2006/0170600 | A1* | 8/2006 | Korva | H01Q 1/244 343/702 |
| 2011/0043408 | A1* | 2/2011 | Shi | H01Q 1/48 343/700 MS |
| 2014/0320349 | A1* | 10/2014 | Lee | H01Q 5/392 343/700 MS |
| 2015/0002340 | A1* | 1/2015 | Liou | H01Q 9/42 343/700 MS |
| 2016/0134017 | A1 | 5/2016 | Lin | |

FOREIGN PATENT DOCUMENTS

CN 105633581 A 6/2016

* cited by examiner

*Primary Examiner* — Awat M Salih
(74) *Attorney, Agent, or Firm* — ScienBiziP, P.C.

(57) ABSTRACT

An antenna assembly of reduced size but with optimized radiation and reception capabilities through slanted connections between the parts includes a feed portion, a first ground portion, a second ground portion, a first radiating portion, and a second radiating portion. The first radiating portion is a loop antenna on at least three surfaces of a carrier, and is connected between the feed portion and the first ground portion on opposite ends. The first radiating portion feeds in electric current through the feed portion. The second radiating portion is spaced from the first radiating portion, the second radiating portion is arranged on at least two surfaces of the carrier. The second radiating portion is connected between the second ground portion, the second radiating portion couples electric current from the first radiating portion. A wireless communication device employing the antenna assembly is also provided.

20 Claims, 10 Drawing Sheets

ANTENNA ASSEMBLY AND WIRELESS COMMUNICATION DEVICE EMPLOYING SAME

FIELD

The subject matter herein generally relates to an antenna assembly and a wireless communication device employing the antenna assembly.

BACKGROUND

Wireless communication devices are always smaller and lighter, but space within is limited. A design for an antenna assembly should consider a radiating performance and arranging wires and other electronic elements. In addition, the limited space for the antenna assembly may affect a frequency width that reduce the radiating performance.

BRIEF DESCRIPTION OF THE DRAWINGS

Implementations of the present technology will now be described, by way of example only, with reference to the attached figures.

DETAILED DESCRIPTION

Figure 1:
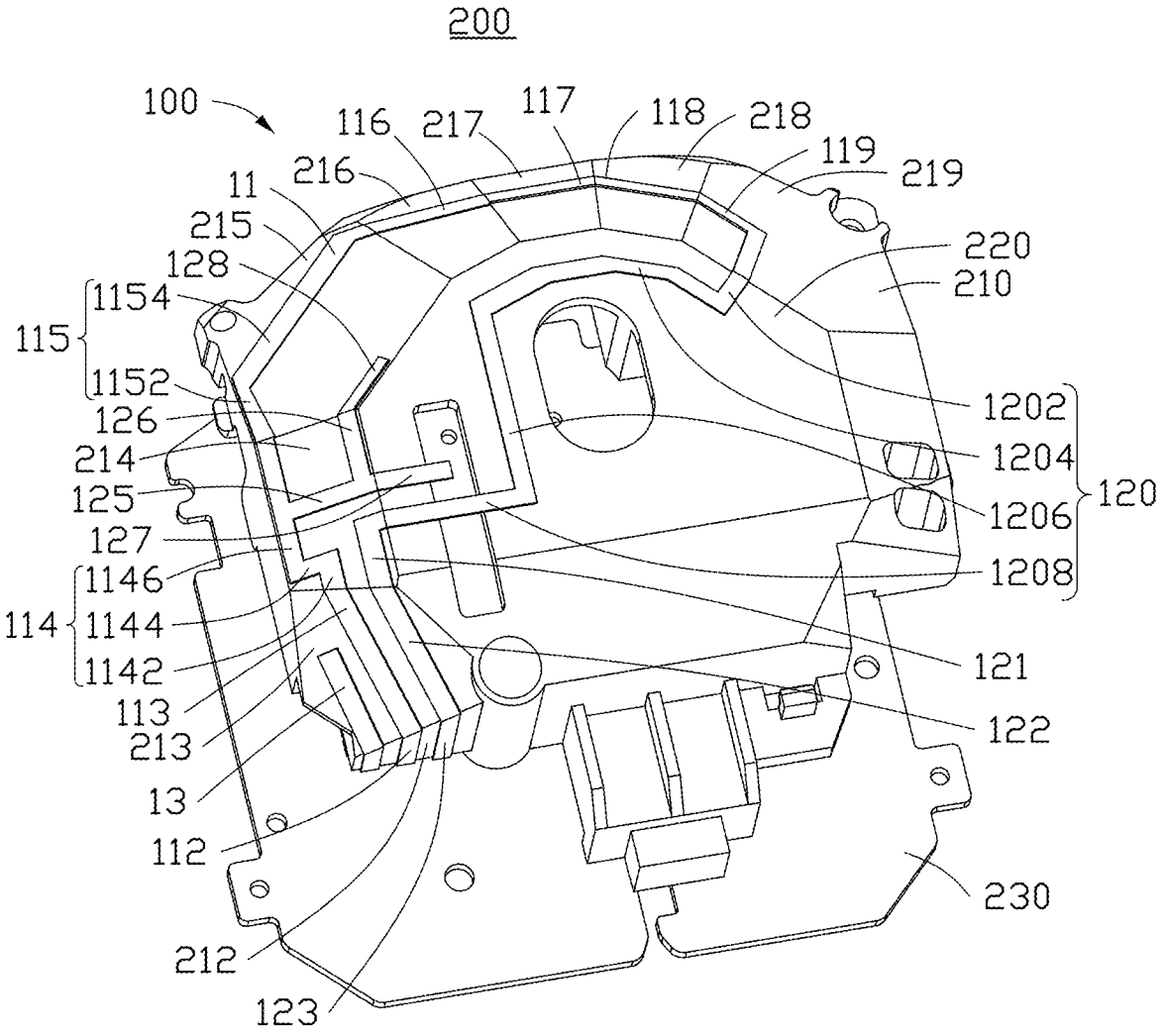
FIG. 1 is an isometric view of an embodiment of a wireless communication device employing an antenna assembly.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or other feature that the term modifies, such that the component need not be exact. The term "comprising," when utilized, means "including, but not necessarily limited to"; it specifically indicates open-ended inclusion or membership in the so-described combination, group, series, and the like.

FIG. 1 illustrates an embodiment of an antenna assembly 100 applied in a wireless communication device 200. The wireless communication device 200 can be a mobile phone, a tablet computer, or a PDA, for transmitting and receiving wireless signals. The wireless communication device 200 further includes a carrier 210 and a circuit board 230. The antenna assembly 100 is carried on the carrier 210 and electrically connected to the circuit board 230.

Figure 2:
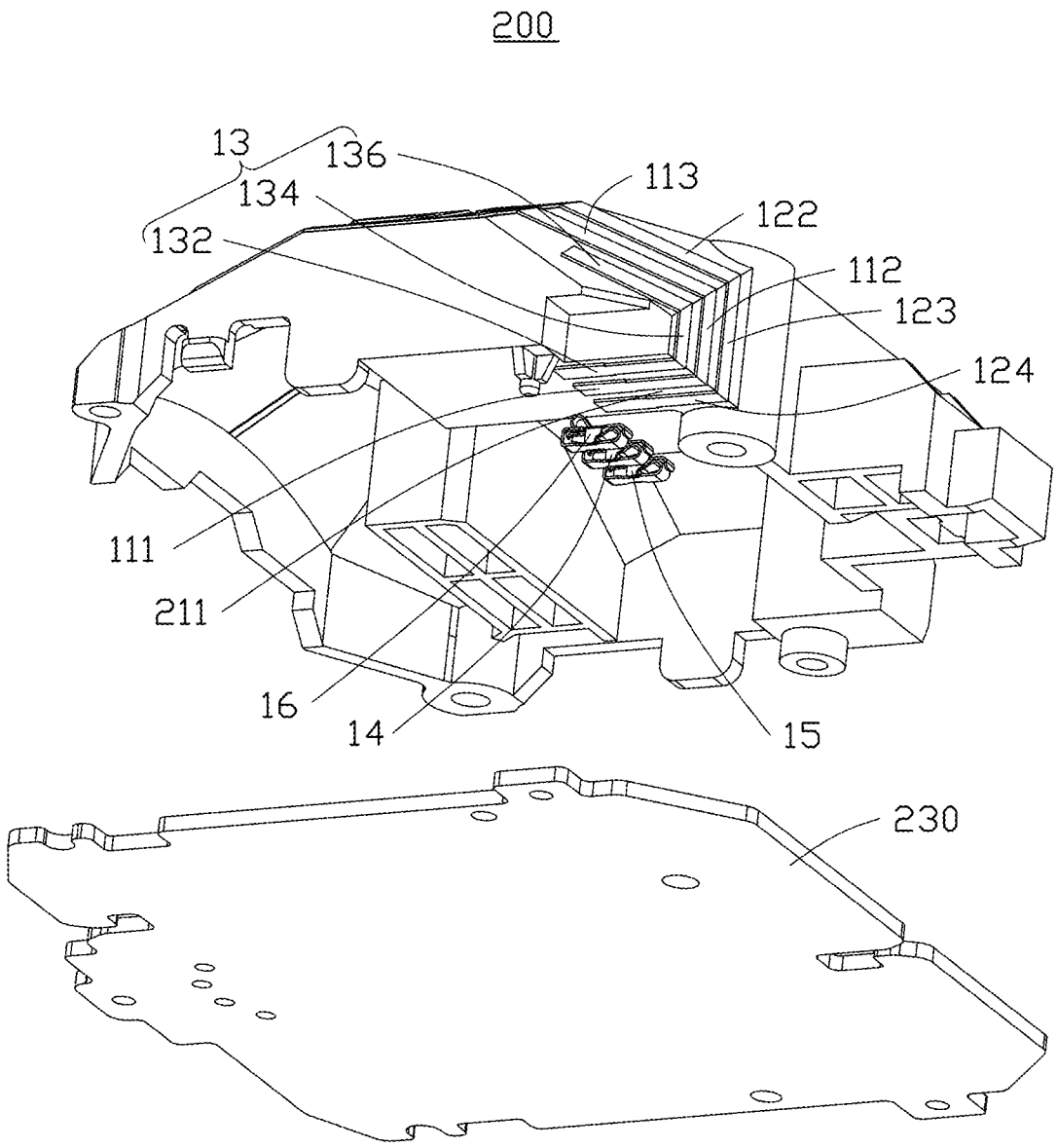
FIG. 2 is another isometric view of the wireless communication device employing the antenna assembly shown in FIG. 1.

Referring to FIGS. 1 and 2, the carrier 210 is a polyhedron structure and includes at least a first surface 211, a second surface 212, a third surface 213, a fourth surface 214, a fifth surface 215, a sixth surface 216, a seventh surface 217, an eighth surface 218, a ninth surface 219, and a tenth surface 220. The first surface 211 and the tenth surface 220 are bottom and top surfaces parallel to each other. An end of the second surface 212 is perpendicularly connected to the first surface 211, the other end of the second surface 212 extends towards the tenth surface 220. The third to ninth surfaces 213-219 are beveled surfaces connected sequentially. The third surface 213 slantingly connects to the second surface 212. The fourth surface 214 slantingly connects to the third surface 213. The fifth surface 215 slantingly connects to the fourth surface 214. The sixth surface 216 slantingly connects to the fifth surface 215. The seventh surface 217 slantingly connects to the sixth surface 216. The eighth surface 218 slantingly connects to the seventh surface 217. The ninth surface 219 slantingly connects to the eighth surface 218. At the same time, the fourth to ninth surfaces 214-219 all slanting connect to the tenth surface 220.

Figure 3:
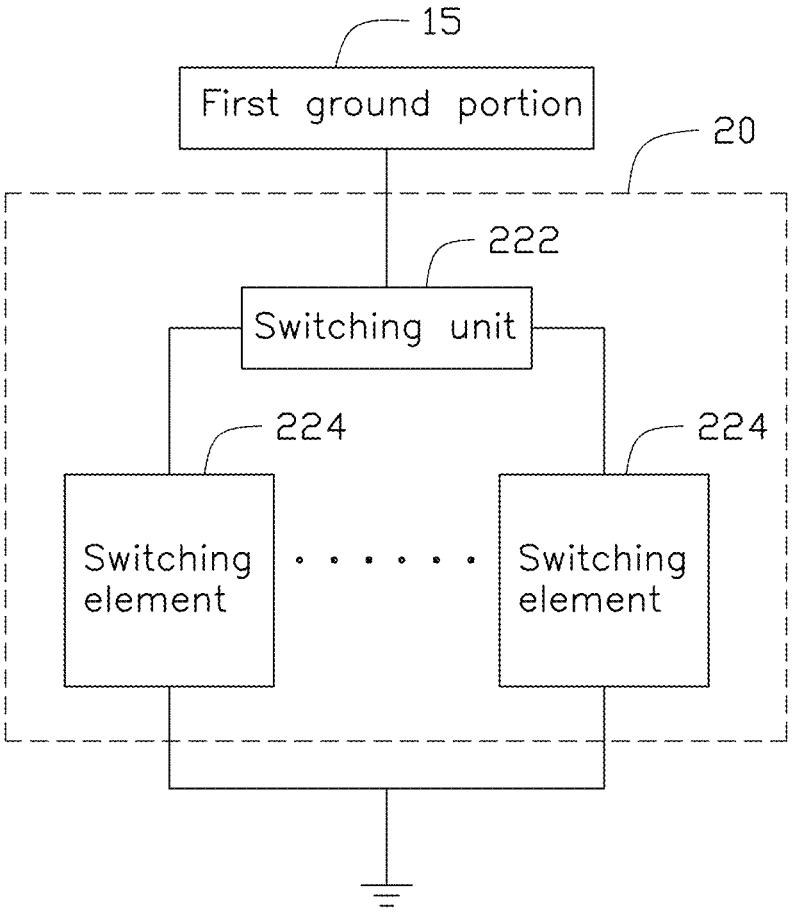
FIG. 3 is a circuit diagram of a switch circuit of the antenna assembly.

Referring to FIGS. 1 and 2, the antenna assembly 100 includes a first radiating portion 11, a second radiating portion 13, a feed portion 14, a ground portion 15, a second ground portion 16, and a switch circuit 20 (shown in FIG. 3).

The first radiating portion 11 is substantially a non-planar ring metal arm coupled to the carrier 210. The first radiating portion 11 includes a first arm 111, a second arm 112, a third arm 113, a fourth arm 114, a fifth arm 115, a sixth arm 116, a seventh arm 117, an eighth arm 118, a ninth arm 119, a tenth arm 120, an eleventh arm 121, a twelfth arm 122, a thirteenth arm 123, a fourteenth arm 124, a fifteenth arm 125, a sixteenth arm 126, a seventeenth arm 127, and an eighteenth arm 128. The first to fourteenth arms 111-124 are connected sequentially.

The first arm 111 is arranged on the first surface 211. The second arm 112 is perpendicularly connected to the first arm 111 and the second arm 112 is arranged on the second surface 212. The third arm 113 slantingly connects to the second arm 112 and the third arm 113 is arranged on the third surface 213. The fourth arm 114 is arranged on the fourth surface 214. The fourth arm 114 includes a first section 1142, a second section 1144, and a third section 1146 connected sequentially. The first section 1142 slantingly connects to the third arm 113. The second section 1144 is perpendicularly connected between the first section 1142 and the third section 1146. The third section 1146 extends along an edge of the fourth surface 214. The fifth arm 115 is substantially an obtuse-angled L-shape. The fifth arm 115 includes a fourth section 1152 and a fifth section 1154. The fourth section 1152 slantingly connects to the third section 1146. One end of the fifth section 1154 is connected to the fourth section 1152 with an obtuse angle, the other end of the fifth section 1154 slantingly connects to the sixth arm 116. The fifth section 1154 is arranged on the fifth surface 215. The sixth arm 116 is arranged on the sixth surface 216. The seventh arm 117 slantingly connects to the sixth arm 116. The seventh arm 117 is arranged on the seventh surface 217. The eighth arm 118 slantingly connects to the seventh arm 117. The eighth arm 118 is arranged on the eighth surface 218. The ninth arm 119 is substantially an obtuse-angled L-shape. One end of the ninth arm 119 slantingly connects to the eighth arm 118. The ninth arm 119 is arranged on the ninth surface 219. The tenth arm 120 is arranged on the tenth surface 220. The tenth arm 120 includes a sixth section 1202, a seventh section 1204, an eighth section 1206, and a ninth section 1208 connected sequentially. The sixth section 1202 slantingly connects to the ninth arm 119. The seventh section 1204 is a curved section which is connected between the sixth section 1202 and the eighth section 1206. The eighth section 1206 and the ninth section 1208 are straight sections. The ninth section 1208 is perpendicularly connected to the eighth section 1206. The ninth section 1208 and the second section 1144 are not collinear. The eleventh arm 121 is substantially L-shaped. One end of the eleventh arm 121 slantingly connects to the ninth section 1208, the other end of the eleventh arm 121 slantingly connects to the twelfth arm 122. The eleventh arm 121 is arranged on the fourth surface 214. The twelfth arm 122 is arranged on the third surface 213 and is parallel to the third arm 113. The thirteenth arm 123 slantingly connects to the twelfth arm 122. The thirteenth arm 123 is parallel to the second arm 112. The thirteenth arm 123 is arranged on the second surface 212. The fourteenth arm 124 is perpendicularly connected to the thirteenth arm 123. The fourteenth arm 124 is parallel to the first arm 111. The fourteenth arm 124 is arranged on the first surface 211.

One end of the fifteenth arm 125 is perpendicularly connected to the third section 1146 of the fourth arm 114. The sixteenth arm 126 is perpendicularly connected to the other end of the fifteenth arm 125. The sixteenth arm 126 is parallel to the third section 1146. The fifteenth arm 125 and the sixteenth arm 126 are arranged on the fourth surface 214. The seventeenth arm 127 slantingly connects to the fifteenth arm 125 along an extending direction of the fifteenth arm 125. The seventeenth arm 127 is parallel to the ninth section 1208 of the tenth arm 120. The seventeenth arm 127 is arranged on the tenth surface 220. The eighteenth arm 128 slantingly connects to the sixteenth arm 126 and is parallel to the fifth section 1154. The eighteenth arm 128 is arranged on the fifth surface 215. Each of the fifteenth arm 125, the sixteenth arm 126, the seventeenth arm 127, and the eighteenth arm 128 is a straight arm. The first radiating portion 11 forms a loop antenna.

The second radiating portion 13 includes a nineteenth arm 132, a twentieth arm 134, and a twenty-first arm 136 connected sequentially. The nineteenth arm 132 is parallel to the first arm 111 and is arranged on the first surface 211. In at least one embodiment, the first arm 111 is parallel between the fourteenth arm 124 and the nineteenth arm 132. The twentieth arm 134 is perpendicularly connected to the nineteenth arm 132 and is parallel to the second arm 112. The twentieth arm 134 is arranged on the second surface 212. In at least one embodiment, the second arm 112 is parallel between the thirteenth arm 123 and the twentieth arm 134. The twenty-first arm 136 slantingly connects to the twentieth arm 134 and is parallel to the third arm 113. The twenty-first arm 136 is arranged on the third surface 213. In at least one embodiment, the third arm 113 is parallel between the twelfth arm 122 and the twenty-first arm 136.

The feed portion 14, the first ground portion 15, and the second ground portion 16 are parallel to each other. The feed portion 14 is located between the first ground portion 15 and the second ground portion 16. The feed portion 14 is electrically connected to the first arm 111 and a feed source of the circuit board 230 and feeds electric current from the feed source to the first radiating portion 11. The first ground portion 15 and the second ground portion 16 are connected to ground of the circuit board 230. The first ground portion 15 is also electrically connected to the fourteenth arm 124 for grounding the first radiating portion 11. The second ground portion 16 is further electrically connected to the nineteenth arm 132 for grounding the second radiating portion 13. In at least one embodiment, the feed portion 14, the first ground portion 15, and the second ground portion 16 are of metal and are elastic.

Referring to FIG. 3, the switch circuit 20 is arranged on the circuit board 230. One end of the circuit board 230 is electrically connected to the first ground portion 15, the other end of the circuit board 230 is connected to the ground of the circuit board 230. The switch circuit 20 includes a switching unit 222 and a plurality of switching elements 224. Each of the switching elements 224 can be an inductor, a capacitor, or a combination of the inductor and the capacitor. The plurality of switching elements 224 are connected in parallel to each other. One end of each switching element 224 is electrically connected to the switching unit 222. The other end of each switching element 224 is electrically grounded. The switching unit 222 is electrically connected between the first ground portion 15 and the plurality of switching elements 224. Through controlling the switching unit 222, the first ground portion 15 can be switched to connect with different switching elements 224. Each switching element 224 has a different impedance, an operating frequency band of the antenna assembly 100 can be adjusted through switching the switching unit 222. For example, a Long Term Evolution Advanced (LTE-A) low frequency band (such as a frequency band of 699-960 MHz) can be offset towards a lower frequency or offset towards a higher frequency (relative to each other).

Figure 4:
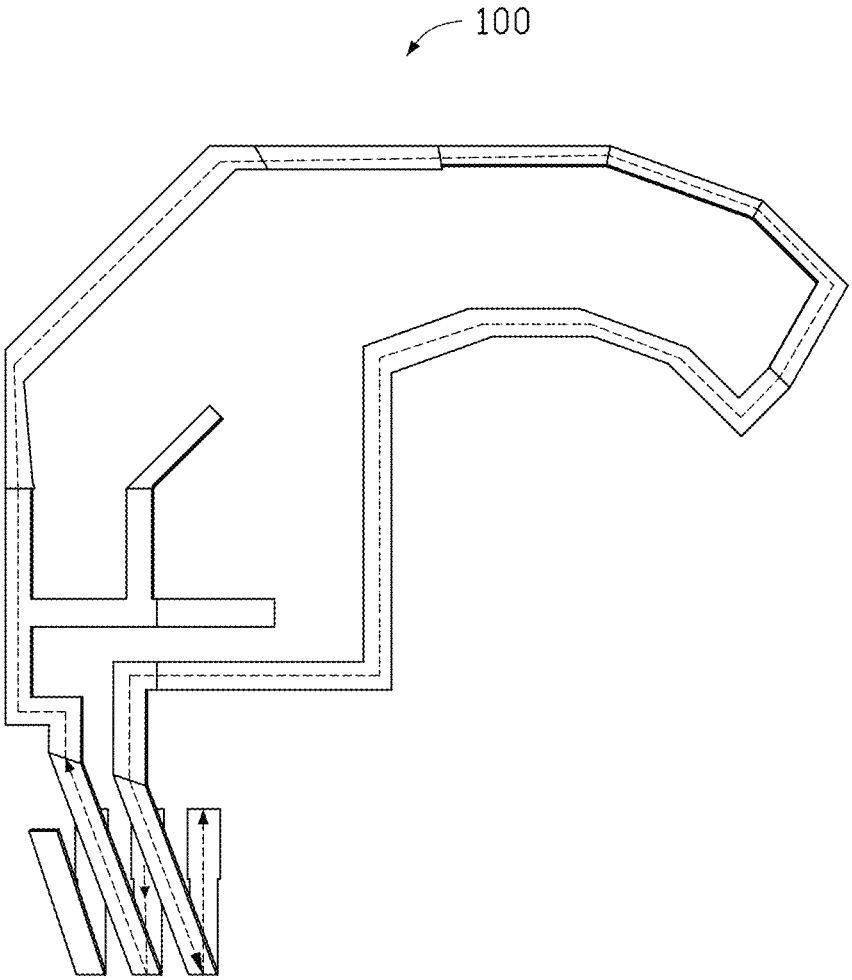
FIG. 4 is a first electric current path diagram of the antenna assembly shown in FIG. 1.

Referring to FIG. 4, the feed portion 14 feeds electric current from the feed source of the circuit board 230 into the first radiating portion 11. The electric current flows through the first arm 111, the second arm 112, the third arm 113, the fourth arm 114, the fifth arm 115, the sixth arm 116, the seventh arm 117, the eighth arm 118, the ninth arm 119, the tenth arm 120, the eleventh arm 121, the twelfth arm 122, the thirteenth arm 123, and the fourteenth arm 124. The electric current further flows through the first ground portion 15 and the switch circuit 20 to ground of the printed circuit board 230, thus, an electric current loop is formed to cooperatively activate a first mode to generate radiation signals in a first frequency band. In this exemplary embodiment, the first mode is an LTE-A low frequency operation mode, the first frequency band is a frequency band of about 699-960 MHz.

Figure 5:
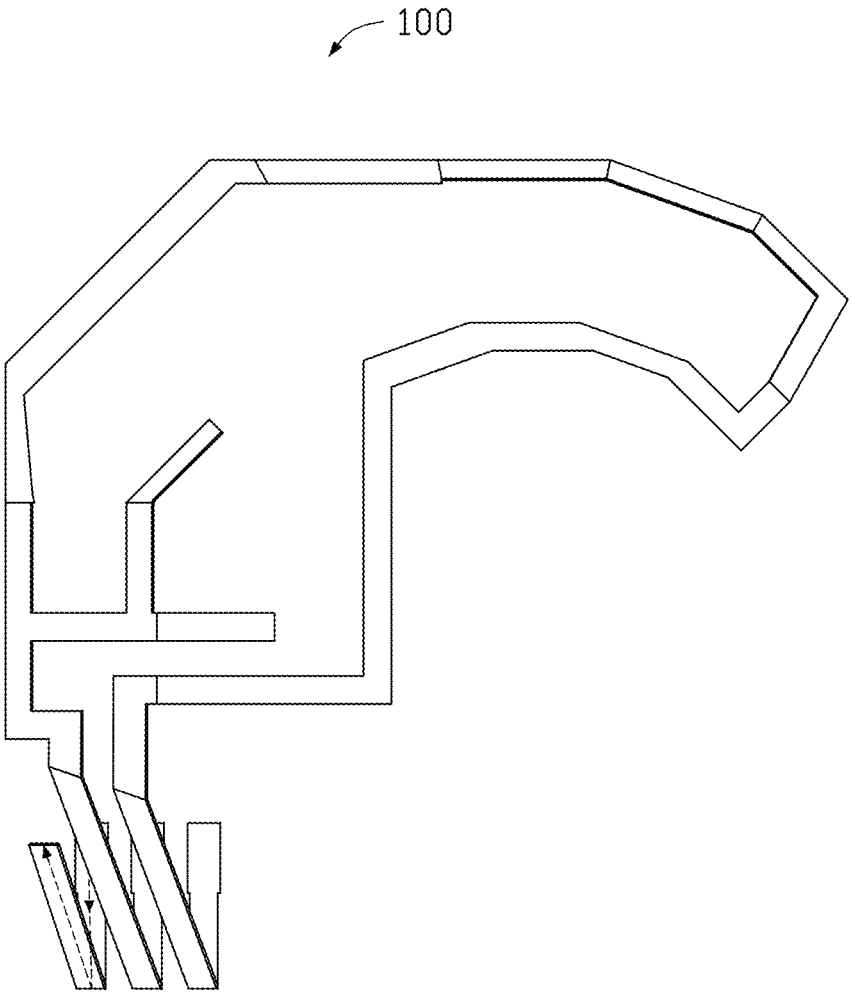
FIG. 5 is a second electric current path diagram of the antenna assembly shown in FIG. 1.

Referring to FIG. 5, the second radiating portion 13 couples electric current from the first radiating portion 11, the electric current flows along the nineteenth arm 132, the twentieth arm 134, and the twenty-first arm 136, and further flows through the second ground portion 16 to the ground, thus to cooperatively activate a second mode to generate radiation signals in a second frequency band. In this exemplary embodiment, the second mode is an LTE-A middle frequency operation mode, the second frequency band is a frequency band of about 1710-1880 MHz.

Figure 6:
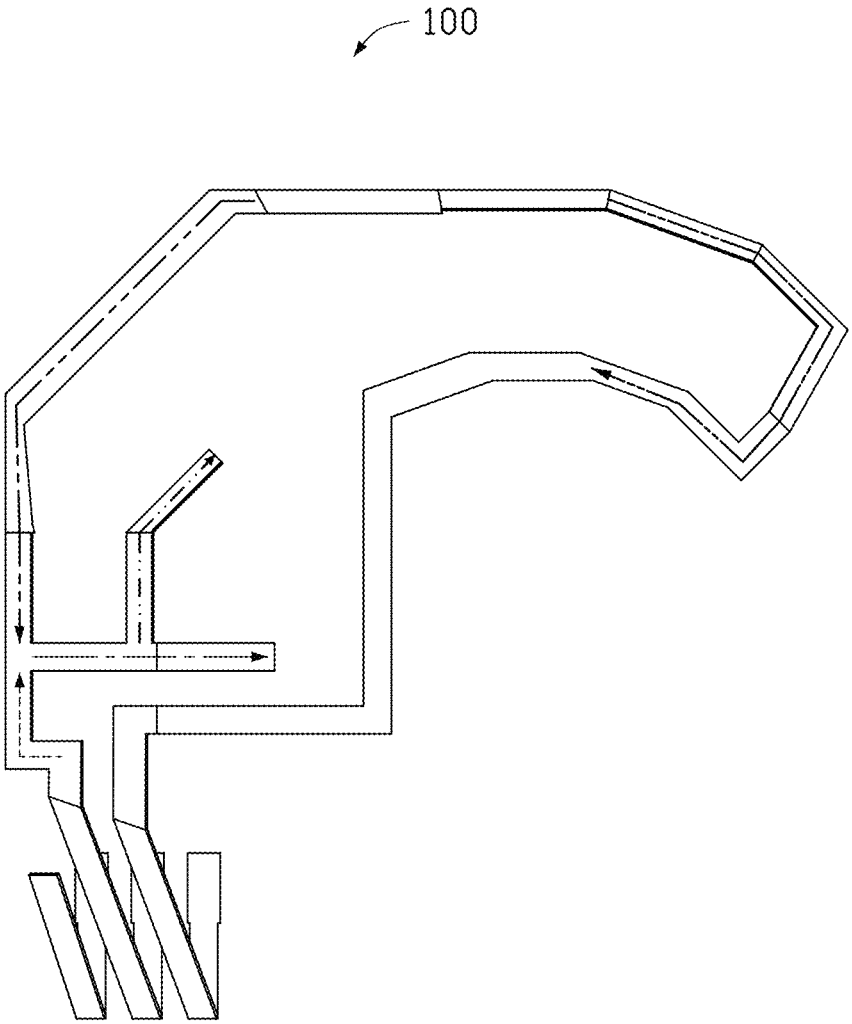
FIG. 6 is a third electric current path diagram of the antenna assembly shown in FIG. 1.

Referring to FIG. 6, the electric current of the first radiating portion 11 further flows along the second section 1144 and the third section 1146 of the fourth arm 114 and the fifth section 1154 and the fourth section 1152 of the fifth arm 115 to the fifteenth arm 115, the seventeenth arm 127, the sixteenth arm 126, and the eighteenth arm 128. The electric current further flows along the eighth arm 118, the ninth arm 119, the sixth section 1202 and the seventh section 1204 of the tenth arm 120, thus to cooperatively activate a third mode to generate radiation signals in a third frequency band. In this exemplary embodiment, the third mode is an LTE-A middle frequency operation mode, the third frequency band is a frequency band of about 1920-2170 MHz.

Figure 7:
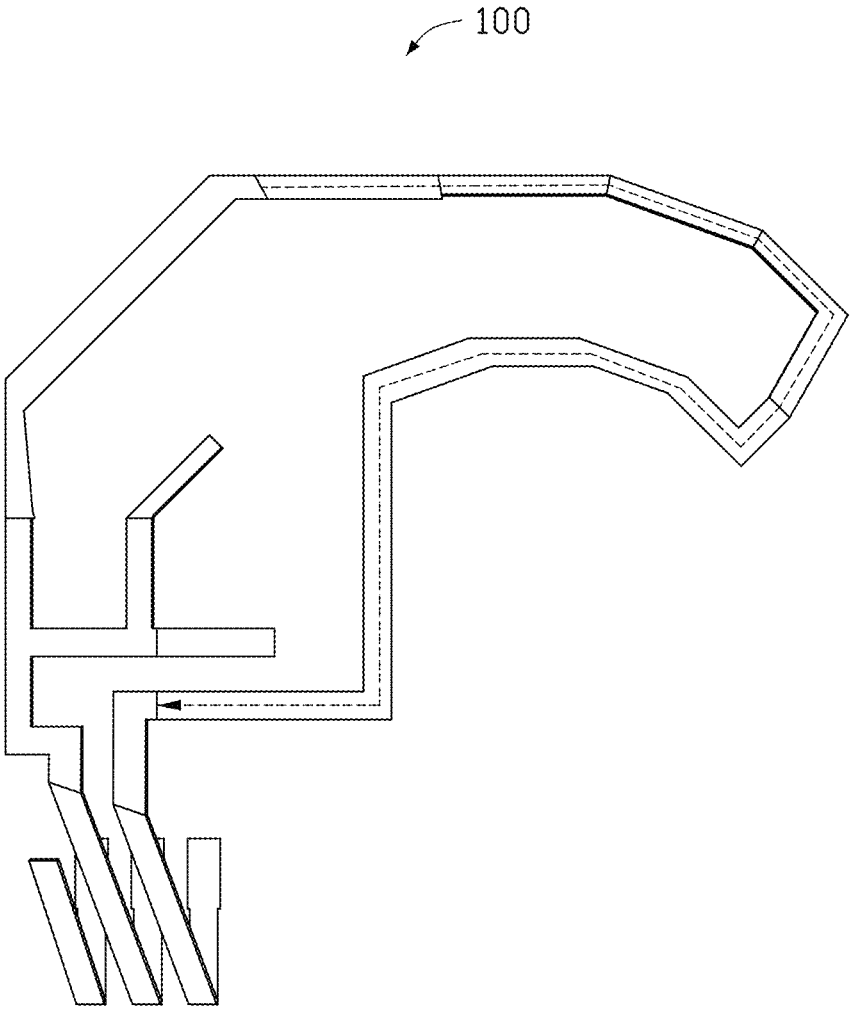
FIG. 7 is a fourth electric current path diagram of the antenna assembly shown in FIG. 1.

Referring to FIG. 7, the electric current of the first radiating portion 11 further flows along the sixth arm 116, the seventh arm 117, the eighth arm 118, the ninth arm 119, and the tenth arm 120, thus to cooperatively activate a fourth mode to generate radiation signals in a fourth frequency band. In this exemplary embodiment, the fourth mode is an LTE-A high frequency operation mode, the fourth frequency band is a frequency band of about 2300-2690 MHz.

Figure 8:
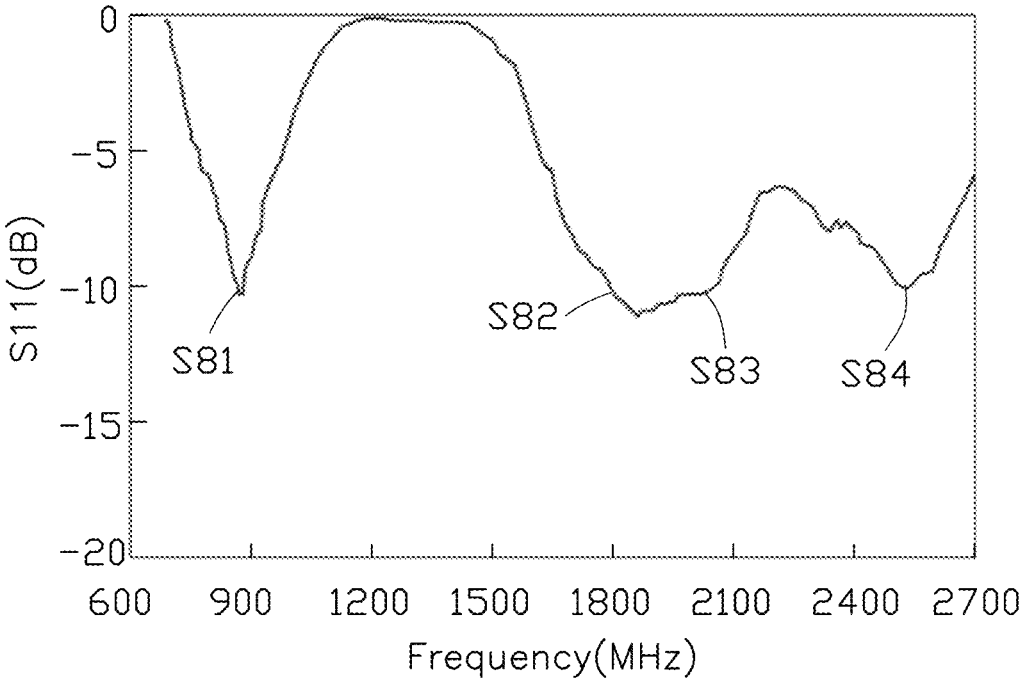
FIG. 8 is a return loss (RL) diagram of the antenna assembly shown in FIG. 1.

FIG. 8 illustrates a return loss (RL) graph of the antenna assembly 100 in operation. Curves S81, S82, S83, and S84 illustrate return losses of the antenna assembly 100 in the first to fourth modes (the first to fourth frequency bands).

Figure 9:
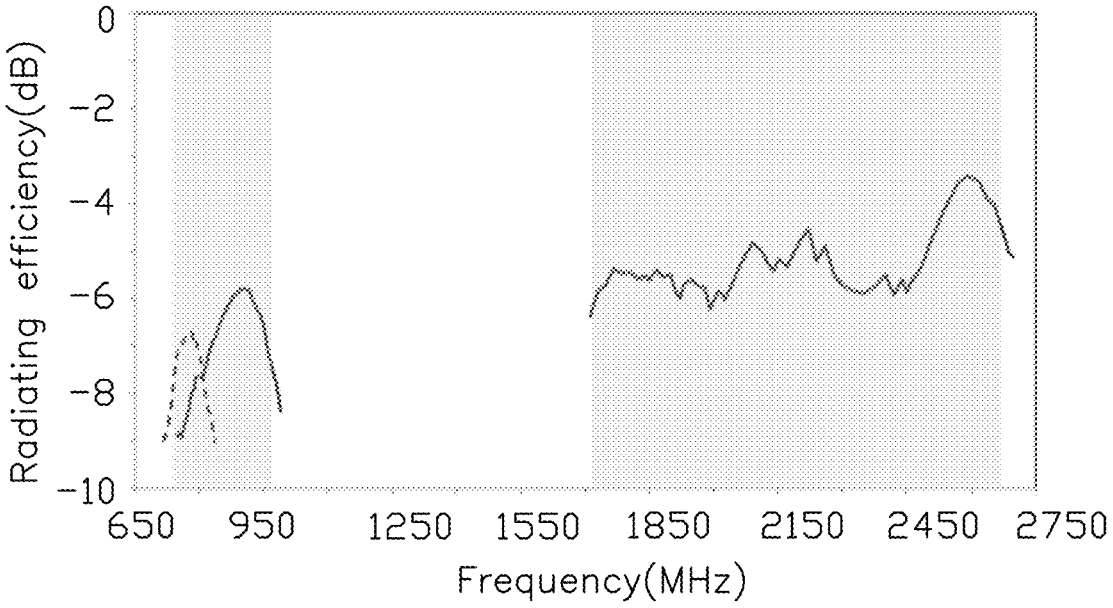
FIG. 9 is an efficiency diagram of the antenna assembly shown in FIG. 1.

FIG. 9 illustrates a radiating efficiency graph of the antenna assembly 100 in operation. Curves illustrate a radiating efficiency of the antenna assembly 100 in the first to fourth frequency bands.

As FIGS. 8 to 9 show, the antenna assembly 100 can work at a low frequency band such as LTE-A low frequency band (704-960 MHz), and middle and high frequency bands (1710-2690 MHz). When the antenna structure 100 operates at these frequency bands, a working frequency satisfies a design of the antenna and also has a good radiating efficiency.

Figure 10:
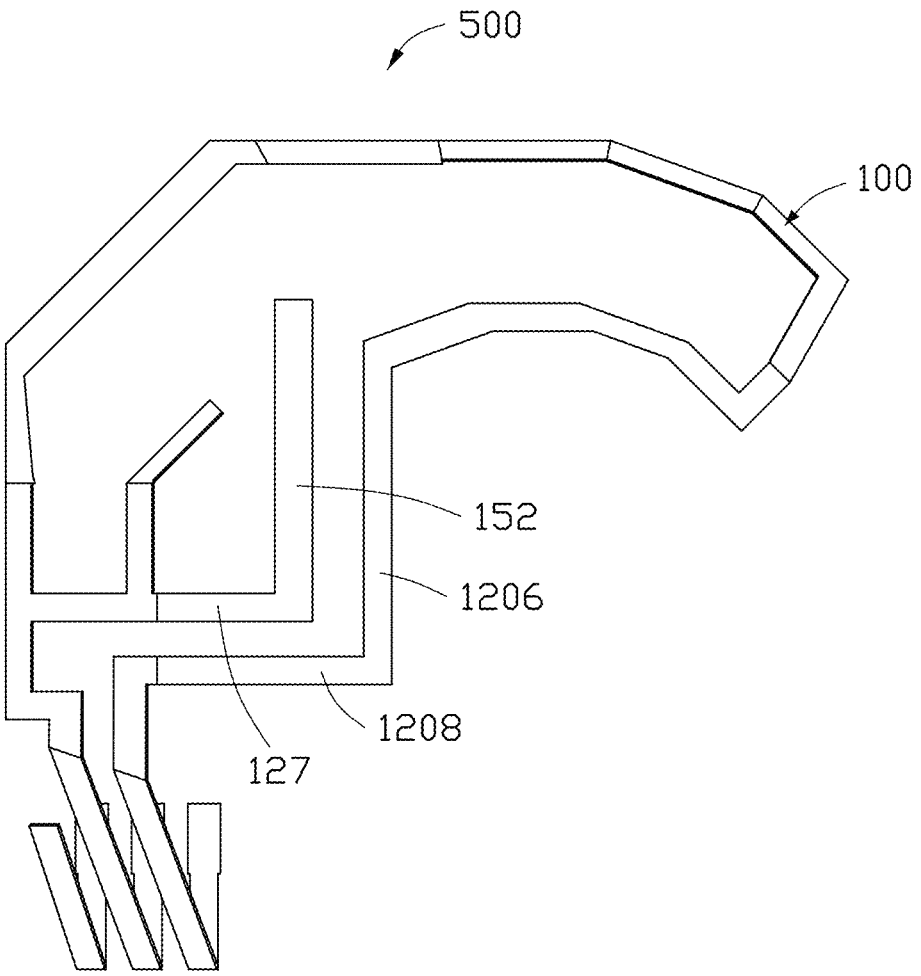
FIG. 10 is an isometric view of another embodiment of an antenna assembly.

Referring to FIG. 10, a second embodiment of an antenna assembly 500 is presented. The antenna assembly 500 is substantially similar to the antenna assembly 100 of the previous embodiment, the antenna assembly 500 further includes an extending arm 152. The extending arm 152 is perpendicularly connected to a free end (an end away from the fifteenth arm 125 and the sixteenth arm 126) of the seventeenth arm 127, the extending arm 152 is opposite to an extending direction of the ninth section 1208. The extending arm 152 is parallel to the eighth section 1206. The extending arm 152 is arranged in the tenth surface 220 (shown in FIG. 1). The extending arm 152 adjusts the third frequency band of the antenna assembly 100 to create an offset towards a lower frequency.

The antenna assembly 100 includes the first radiating portion 11 and the second radiating portion 13 arranged on multiple surfaces of the carrier 210. This arrangement optimizes design parameters for inner space of the wireless communication device 200. Meanwhile, the antenna assembly 100 can work over wide frequency bands and has a good radiating efficiency.

It is believed that the embodiments and their advantages will be understood from the foregoing description, and it will be apparent that various changes may be made thereto without departing from the scope of the disclosure or sacrificing all of its advantages, the examples hereinbefore described merely being illustrative embodiments of the disclosure.

What is claimed is:

1. An antenna assembly, arranged in a carrier of a wireless communication device, the antenna assembly comprising:

a feed portion;

a first ground portion;

a second ground portion;

a first radiating portion, wherein the first radiating portion is a loop antenna and arranged on at least three surfaces of the carrier, the first radiating portion is electrically connected between the feed portion and the first ground portion on opposite ends, the first radiating portion feeds in electric current from a feed source through the feed portion; and a second radiating portion, wherein the second radiating portion is spaced from the first radiating portion, the second radiating portion is arranged on at least two surfaces of the carrier, the second radiating portion is electrically connected to the second ground portion, the second radiating portion couples the electric current from the first radiating portion;

wherein the first radiating portion comprises a first arm, a second arm, a third arm, and a fourth arm; the first arm is arranged on a first surface of the carrier; the second arm is perpendicularly connected to the first arm and is arranged on a second surface of the carrier; the third arm slantingly connects to the second arm and is arranged on a third surface of the carrier; the fourth arm is arranged on a fourth surface of the carrier.

2. The antenna assembly as claimed in claim 1, wherein the first radiating portion further comprises a fifth arm, a sixth arm, a seventh arm, an eighth arm, a ninth arm, a tenth arm, an eleventh arm, a twelfth arm, a thirteenth arm, a fourteenth arm, a fifteenth arm, a sixteenth arm, a seventeenth arm, and an eighteenth arm connected sequentially; the fourth arm includes a first section, a second section, and a third section connected sequentially; the first section slantingly connects to the third arm; the second section is perpendicularly connected between the first section and the third section; the third section extends along an edge of the fourth surface; the fifth arm is an obtuse-angled L-shape and includes a fourth section and a fifth section; the fourth section slantingly connects to the third section; one end of the fifth section is connected to the fourth section with an obtuse angle, the other end of the fifth section slantingly connects to the sixth arm; the fifth section is arranged on a fifth surface of the carrier; the sixth arm is arranged on the sixth surface of the carrier; the seventh arm slantingly connects to the sixth arm and is arranged on a seventh surface of the carrier.

3. The antenna assembly as claimed in claim 2, wherein the eighth arm slantingly connects to the seventh arm and is arranged on a eighth surface of the carrier; the ninth arm is an obtuse-angled L-shape and is arranged on a ninth surface of the carrier, one end of the ninth arm slantingly connects to the eighth arm; the tenth arm is arranged on a tenth surface of the carrier and includes a sixth section, a seventh section, an eighth section, and a ninth section connected sequentially; the sixth section slantingly connects to the ninth arm, the seventh section is a curved section and connected between the sixth section and the eighth section; the eighth section and the ninth section are straight sections; the ninth section is perpendicularly connected to the eighth section; the ninth section and the second section are not collinear; the eleventh arm is L-shaped, one end of the eleventh arm slantingly connects to the ninth section, the other end of the eleventh arm slantingly connects to the twelfth arm; the eleventh arm is arranged on the fourth surface; the twelfth arm is arranged on the third surface and is parallel to the third arm; the thirteenth arm slantingly connects to the twelfth arm and is parallel to the second arm, the thirteenth arm is arranged on the second surface; the fourteenth arm is perpendicularly connected to the thirteenth arm and is parallel to the first arm, the fourteenth arm is arranged on the first surface.

4. The antenna assembly as claimed in claim 3, wherein one end of the fifteenth arm is perpendicularly connected to the third section of the fourth arm; the sixteenth arm is perpendicularly connected to the other end of the fifteenth arm and is parallel to the third section; the fifteenth arm and the sixteenth arm are arranged on the fourth surface; the seventeenth arm slantingly connects to the fifteenth arm along an extending direction of the fifteenth arm; the seventeenth arm is parallel to the ninth section of the tenth arm and arranged on the tenth surface; the eighteenth arm slantingly connects to the sixteenth arm and is parallel to the fifth section; the eighteenth arm is arranged on the fifth surface; each of the fifteenth arm, the sixteenth arm, the seventeenth arm, and the eighteenth arm is a straight arm; each of the first to tenth surfaces defines a plane.

5. The antenna assembly as claimed in claim 4, wherein the second radiating portion comprises a nineteenth arm, a twentieth arm, and a twenty-first arm connected sequentially; the nineteenth arm is parallel to the first arm and arranged on the first surface; the first arm is parallel between the fourteenth arm and the nineteenth arm; the twentieth arm is perpendicularly connected to the nineteenth arm and is parallel to the second arm; the twentieth arm is arranged on the second surface; the second arm is parallel between the thirteenth arm and the twentieth arm; the twenty-first arm slantingly connects to the twentieth arm and is parallel to the third arm; the twenty-first arm is arranged on the third surface; the third arm is parallel between the twelfth arm and the twenty-first arm.

6. The antenna assembly as claimed in claim 5, wherein the feed portion, the first ground portion, and the second ground portion are parallel to each other; the feed portion is located between the first ground portion and the second ground portion; the feed portion is electrically connected to the first arm and a feed source and feeds electric current from the feed source to the first radiating portion; the first ground portion and the second ground portion are connected to ground; the first ground portion is further electrically connected to the fourteenth arm for grounding the first radiating portion; the second ground portion is further electrically connected to the nineteenth arm for grounding the second radiating portion.

7. The antenna assembly as claimed in claim 6, wherein the feed portion feeds electric current from the feed source into the first radiating portion, the electric current flows through the first arm, the second arm, the third arm, the fourth arm, the fifth arm, the sixth arm, the seventh arm, the eighth arm, the ninth arm, the tenth arm, the eleventh arm, the twelfth arm, the thirteenth arm, and the fourteenth arm, the electric current further flows through the first ground portion to ground, thus, an electric current loop is formed to cooperatively activate a first mode to generate radiation signals in a first frequency band; the second radiating portion couples electric current from the first radiating portion, the electric current flows along the nineteenth arm, the twentieth arm, and the twenty-first arm, and further flows through the second ground portion to the ground, thus to cooperatively activate a second mode to generate radiation signals in a second frequency band.

8. The antenna assembly as claimed in claim 7, further comprising a switch circuit, wherein the switch circuit comprises a switching unit and a plurality of switching elements; the plurality of switching elements are connected in parallel to each other; one end of each of the plurality of switching elements is electrically connected to the switching unit, the other end of each of the plurality of switching elements is electrically grounded; the switching unit is electrically connected between the first ground portion and the plurality of switching elements; each of the plurality of switching elements has a different impedance, through controlling the switching unit, the first ground portion is switched to connect with different switching elements, the first frequency band is adjustable towards a lower frequency or a higher frequency.

9. The antenna assembly as claimed in claim 8, wherein the electric current of the first radiating portion further flows along the second section and the third section of the fourth arm and the fifth section and the fourth section of the fifth arm to the fifteenth arm, the seventeenth arm, the sixteenth arm, and the eighteenth arm, the electric current further flows along the eighth arm, the ninth arm, the sixth section and the seventh section of the tenth arm, thus to cooperatively activate a third mode to generate radiation signals in a third frequency band; the electric current of the first radiating portion further flows along the sixth arm, the seventh arm, the eighth arm, the ninth arm, and the tenth arm, thus to cooperatively activate a fourth mode to generate radiation signals in a fourth frequency band; the frequencies of the first frequency band is smaller than frequencies of the second frequency band, the frequencies of the second frequency band is smaller than frequencies of the third frequency band, and the frequencies of the third frequency band is smaller than frequencies of the fourth frequency band.

10. The antenna assembly as claimed in claim 9, wherein the first radiating portion further comprises an extending arm, the extending arm is perpendicularly connected to an end of the seventeenth arm that away from the fifteenth arm and the sixteenth arm, the extending arm extends opposite to an extending direction of the ninth section; the extending arm is parallel to the eighth section and arranged in the tenth surface; the extending arm is configured to adjust the third frequency band to be offset towards a lower frequency.

11. A wireless communication device comprising:

a carrier comprising multiple surfaces;

a circuit board providing a feed source and a ground; and an antenna assembly arranging on the multiple surfaces of the carrier, the antenna assembly comprising:

a feed portion electrically connecting to the feed source;

a first ground portion electrically connecting to the ground;

a second ground portion electrically connecting to the ground;

a first radiating portion, wherein the first radiating portion is a loop antenna and arranged on at least three surfaces of the carrier, the first radiating portion is electrically connected between the feed portion and the first ground portion on opposite ends, the first radiating portion feeds in electric current from the feed source through the feed portion; and a second radiating portion, wherein the second radiating portion is spaced from the first radiating portion, the second radiating portion is arranged on at least two surfaces of the carrier, the second radiating portion is electrically connected to the second ground portion, the second radiating portion couples the electric current from the first radiating portion;

wherein the first radiating portion comprises a first arm, a second arm, a third arm, and a fourth arm; the first arm is arranged on a first surface of the carrier; the second arm is perpendicularly connected to the first arm and is arranged on a second surface of the carrier; the third arm slantingly connects to the second arm and is arranged on a third surface of the carrier; the fourth arm is arranged on a fourth surface of the carrier.

12. The wireless communication device as claimed in claim 11, wherein the first radiating portion further comprises a fifth arm, a sixth arm, a seventh arm, an eighth arm, a ninth arm, a tenth arm, an eleventh arm, a twelfth arm, a thirteenth arm, a fourteenth arm, a fifteenth arm, a sixteenth arm, a seventeenth arm, and an eighteenth arm connected sequentially; the fourth arm includes a first section, a second section, and a third section connected sequentially; the first section slantingly connects to the third arm; the second section is perpendicularly connected between the first section and the third section; the third section extends along an edge of the fourth surface; the fifth arm is an obtuse-angled L-shape and includes a fourth section and a fifth section; the fourth section slantingly connects to the third section; one end of the fifth section is connected to the fourth section with an obtuse angle, the other end of the fifth section slantingly connects to the sixth arm; the fifth section is arranged on a fifth surface of the carrier; the sixth arm is arranged on the sixth surface of the carrier; the seventh arm slantingly connects to the sixth arm and is arranged on a seventh surface of the carrier.

13. The wireless communication device as claimed in claim 12, wherein the eighth arm slantingly connects to the seventh arm and is arranged on a eighth surface of the carrier; the ninth arm is an obtuse-angled L-shape and is arranged on a ninth surface of the carrier, one end of the ninth arm slantingly connects to the eighth arm; the tenth arm is arranged on a tenth surface of the carrier and includes a sixth section, a seventh section, an eighth section, and a ninth section connected sequentially; the sixth section slantingly connects to the ninth arm, the seventh section is a curved section and connected between the sixth section and the eighth section; the eighth section and the ninth section are straight sections; the ninth section is perpendicularly connected to the eighth section; the ninth section and the second section are not collinear; the eleventh arm is L-shaped, one end of the eleventh arm slantingly connects to the ninth section, the other end of the eleventh arm slantingly connects to the twelfth arm; the eleventh arm is arranged on the fourth surface; the twelfth arm is arranged on the third surface and is parallel to the third arm; the thirteenth arm slantingly connects to the twelfth arm and is parallel to the second arm, the thirteenth arm is arranged on the second surface; the fourteenth arm is perpendicularly connected to the thirteenth arm and is parallel to the first arm, the fourteenth arm is arranged on the first surface.

14. The wireless communication device as claimed in claim 13, wherein one end of the fifteenth arm is perpendicularly connected to the third section of the fourth arm; the sixteenth arm is perpendicularly connected to the other end of the fifteenth arm and is parallel to the third section; the fifteenth arm and the sixteenth arm are arranged on the fourth surface; the seventeenth arm slantingly connects to the fifteenth arm along an extending direction of the fifteenth arm; the seventeenth arm is parallel to the ninth section of the tenth arm and arranged on the tenth surface; the eighteenth arm slantingly connects to the sixteenth arm and is parallel to the fifth section; the eighteenth arm is arranged on the fifth surface; each of the fifteenth arm, the sixteenth arm, the seventeenth arm, and the eighteenth arm is a straight arm; each of the first to tenth surfaces defines a plane.

15. The wireless communication device as claimed in claim 14, wherein the second radiating portion comprises a nineteenth arm, a twentieth arm, and a twenty-first arm connected one by one; the nineteenth arm is parallel to the first arm and arranged on the first surface; the first arm is parallel between the fourteenth arm and the nineteenth arm; the twentieth arm is perpendicularly connected to the nineteenth arm and is parallel to the second arm; the twentieth arm is arranged on the second surface; the second arm is parallel between the thirteenth arm and the twentieth arm; the twenty-first arm slantingly connects to the twentieth arm and is parallel to the third arm; the twenty-first arm is arranged on the third surface; the third arm is parallel between the twelfth arm and the twenty-first arm.

16. The wireless communication device as claimed in claim 15, wherein feed portion, the first ground portion, and the second ground portion are parallel to each other; the feed portion is located between the first ground portion and the second ground portion; the feed portion is electrically connected to the first arm and a feed source and feeds electric current from the feed source to the first radiating portion; the first ground portion and the second ground portion are connected to the ground; the first ground portion is further electrically connected to the fourteenth arm for grounding the first radiating portion; the second ground portion is further electrically connected to the nineteenth arm for grounding the second radiating portion.

17. The wireless communication device as claimed in claim 16, wherein the feed portion feeds electric current from the feed source into the first radiating portion, the electric current flows through the first arm, the second arm, the third arm, the fourth arm, the fifth arm, the sixth arm, the seventh arm, the eighth arm, the ninth arm, the tenth arm, the eleventh arm, the twelfth arm, the thirteenth arm, and the fourteenth arm, the electric current further flows through the first ground portion to the ground, thus, an electric current loop is formed to cooperatively activate a first mode to generate radiation signals in a first frequency band; the second radiating portion couples the electric current from the first radiating portion, the electric current flows along the nineteenth arm, the twentieth arm, and the twenty-first arm, and further flows through the second ground portion to the ground, thus to cooperatively activate a second mode to generate radiation signals in a second frequency band.

18. The wireless communication device as claimed in claim 17, wherein the antenna assembly further comprises a switch circuit, the switch circuit comprises a switching unit and a plurality of switching elements; the plurality of switching elements are connected in parallel to each other; one end of each of the plurality of switching elements is electrically connected to the switching unit, the other end of each of the plurality of switching elements is electrically grounded; the switching unit is electrically connected between the first ground portion and the plurality of switching elements; each of the plurality of switching elements has a different impedance, through controlling the switching unit, the first ground portion is switched to connect with different switching elements, the first frequency band is adjustable towards a lower frequency or a higher frequency.

19. The wireless communication device as claimed in claim 18, wherein the electric current of the first radiating portion further flows along the second section and the third section of the fourth arm and the fifth section and the fourth section of the fifth arm to the fifteenth arm, the seventeenth arm, the sixteenth arm, and the eighteenth arm, the electric current further flows along the eighth arm, the ninth arm, the sixth section and the seventh section of the tenth arm, thus to cooperatively activate a third mode to generate radiation signals in a third frequency band; the electric current of the first radiating portion further flows along the sixth arm, the seventh arm, the eighth arm, the ninth arm, and the tenth arm, thus to cooperatively activate a fourth mode to generate radiation signals in a fourth frequency band; the frequencies of the first frequency band is smaller than frequencies of the second frequency band, the frequencies of the second frequency band is smaller than frequencies of the third frequency band, and the frequencies of the third frequency band is smaller than frequencies of the fourth frequency band.

20. The wireless communication device as claimed in claim 19, wherein the first radiating portion further comprises an extending arm, the extending arm is perpendicularly connected to an end of the seventeenth arm that away from the fifteenth arm and the sixteenth arm, the extending arm extends opposite to an extending direction of the ninth section; the extending arm is parallel to the eighth section and arranged in the tenth surface; the extending arm is configured to adjust the third frequency band to be offset towards a lower frequency.

* * * * *